US008739430B2

(12) United States Patent
Fukaya et al.

(10) Patent No.: US 8,739,430 B2
(45) Date of Patent: Jun. 3, 2014

(54) HAND DRYING APPARATUS

(75) Inventors: Yoshihiro Fukaya, Tokyo (JP); Takaki Kobayashi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 256 days.

(21) Appl. No.: 12/937,386

(22) PCT Filed: Apr. 23, 2008

(86) PCT No.: PCT/JP2008/057850
§ 371 (c)(1),
(2), (4) Date: Oct. 12, 2010

(87) PCT Pub. No.: WO2009/130769
PCT Pub. Date: Oct. 29, 2009

(65) Prior Publication Data
US 2011/0023319 A1 Feb. 3, 2011

(51) Int. Cl.

| | |
|---|---|
| ***F26B 25/08*** | (2006.01) |
| ***F26B 19/00*** | (2006.01) |
| ***F26B 21/06*** | (2006.01) |
| ***F26B 21/00*** | (2006.01) |

(52) U.S. Cl.
USPC ..... 34/202; 34/77; 34/565; 34/572

(58) Field of Classification Search
USPC ..... 34/202, 77, 90, 524; 70/292, 312; 109/44
See application file for complete search history.

(56) References Cited

U.S. PATENT DOCUMENTS

| | | | | | |
|---|---|---|---|---|---|
| 529,886 | A | * | 11/1894 | Waddel | 70/88 |
| 4,101,685 | A | * | 7/1978 | Geary et al. | 427/8 |
| 4,772,877 | A | * | 9/1988 | Rice et al. | 340/543 |
| 5,217,288 | A | * | 6/1993 | Johnson | 312/257.1 |

(Continued)

FOREIGN PATENT DOCUMENTS

| | | |
|---|---|---|
| CN | 2536174 Y | 2/2003 |
| CN | 1896596 | 1/2007 |

(Continued)

OTHER PUBLICATIONS

Office Action (Notice of Rejection) dated Apr. 17, 2012, issued by the Japanese Patent office in the corresponding Japanese Patent Application No. 2010-508998 and an English Translation thereof. (11 pages).

(Continued)

*Primary Examiner* — Len Tran
*Assistant Examiner* — Tiffany Johnson
(74) *Attorney, Agent, or Firm* — Buchanan Ingersoll & Rooney PC

(57) ABSTRACT

A hand drying apparatus includes a main box body in which a hand insertion portion is provided for allowing insertion/pulling out of hands and a water pan is provided for collecting water drops blown away from hands. In the main box body, a drain tank is disposed for accumulating water that is collected in the water pan. The drain tank is attached to the main box body in a detachable manner. A first lock mechanism is disposed for restricting removal of the drain tank. Moreover, an operating unit is disposed for switching the operating state of the apparatus and is covered with an openable-closable operating unit cap. A third lock mechanism is disposed for restricting opening and closing of the operating unit cap.

15 Claims, 7 Drawing Sheets

(56) References Cited

U.S. PATENT DOCUMENTS

| | | | | | |
|---|---|---|---|---|---|
| 5,568,691 | A * | 10/1996 | Rubin | 34/98 |
| 5,873,178 | A * | 2/1999 | Johnson | 34/90 |
| 6,715,215 | B1 * | 4/2004 | Yeung | 34/96 |
| 7,185,804 | B1 * | 3/2007 | Rozlosnik et al. | 235/379 |
| 2006/0171660 | A1 | 8/2006 | Hsu | |

FOREIGN PATENT DOCUMENTS

| | | | | |
|---|---|---|---|---|
| JP | 62-078193 | U | 5/1987 | |
| JP | 10-075915 | A | 3/1998 | |
| JP | 11-244192 | A | 9/1999 | |
| JP | 2000-000181 | A | 1/2000 | |
| JP | 2001-008855 | A | 1/2001 | |
| JP | 2001-327433 | A | 11/2001 | |
| JP | 2001-527427 | | 12/2001 | |
| JP | 2002-194935 | A | 7/2002 | |
| JP | 2004-308117 | A | 11/2004 | |
| JP | 2005-174593 | A | 6/2005 | |
| JP | 2006-187308 | A | 7/2006 | |
| JP | 2006-288586 | A | 10/2006 | |
| JP | 2007-024341 | A | 2/2007 | |
| TW | I278300 | | 4/2007 | |
| WO | WO 96/10349 | | 4/1996 | |
| WO | 2006/058370 | A1 | 6/2006 | |
| WO | WO2007/013142 | * | 2/2007 | F26B 21/06 |

OTHER PUBLICATIONS

International Search Report (PCT/ISA/210) issued on Jul. 15, 2008, by Japanese Patent Office as the International Searching Authority for International Application No. PCT/JP2008/057850.

Written Opinion (PCT/ISA/237) issued on Jul. 15, 2008, by Japanese Patent Office as the International Searching Authority for International Application No. PCT/JP2008/057850.

Office Action dated Mar. 8, 2011, issued in the corresponding Taiwan Patent Application No. 097118362.

Decision of a Patent Grant issued on Dec. 26, 2012 by the Korean Patent Office in a corresponding Korean application.

First Office Action issued on Sep. 29, 2012 by the Chinese Office Action in corresponding Chinese Application No. 2008801287317, and an English translation thereof.

Office Action (Notice of Rejection) issued on Dec. 24, 2013, by the Japanese Patent Office in corresponding Japanese Patent Application No. 2012-136311, and an English Translation of the Office Action. (3 pages).

* cited by examiner

HAND DRYING APPARATUS

TECHNICAL FIELD

The present invention relates to a hand drying apparatus for hygienic drying of wet hands after hand-washing, and more particularly relates to a hand drying apparatus that includes a drain tank or an air filter attached to a main body in a detachable manner or includes an openable-closable operating unit.

BACKGROUND ART

As apparatuses for drying wet hands after hand-washing, hand drying apparatuses are available that make use of a high-speed airstream for blowing away the water drops attached to the hands. In such an apparatus, in a main box body forming an outer casing, a hand insertion portion in a hollow shape is provided as a processing space. In the hand insertion portion, an air nozzle is disposed and to the air nozzle, an air duct is joined. In turn, the air duct is connected to an air blower (high-pressure airstream generating device) that blows a high-pressure airstream into the hand insertion portion. During a hand drying operation, the water blown away inside the hand insertion portion is drained into a drain tank disposed beneath the hand insertion portion via a water pan, which is disposed at the bottom of the hand insertion portion. Herein, Patent Literature 1 and Patent Literature 2 are referred to for the disclosure of relevant conventional technologies.

Patent Literature 1: Japanese Patent Application Laid-open No. H11-244192

Patent Literature 2: Japanese Patent Application Laid-open No. 2001-327433

DISCLOSURE OF INVENTION

Problem to be Solved by the Invention

In a hand drying apparatus for drying hands with a high-pressure airstream; as a protection for an air blower, an air filter is necessary for removing dust from the indrawn air. Besides, a drain tank is also necessary for accumulating the water blown away while drying the hands so that the blown water does not drip onto the floor. In Patent Literature 1, in order to solve the problem of forgetting to attach the drain tank or the air filter after cleaning the apparatus, the drain tank and the air filter are linked together. Besides, the hand drying apparatus is configured not to operate unless the air filter is attached. In the case of such a configuration, if the drain tank or the air filter goes missing due to a mischief or theft; that can cause dripping of water onto the floor, drawing in of dust or foreign objects, or shutdown for a prolonged period of time.

Furthermore, a hand drying apparatus includes a power ON/OFF switch that is used at the time of cleaning the main body or switching OFF the hand drying apparatus when it is not used for a long period of time. In Patent Literature 2, in order to prevent a power ON/OFF switch from coming in direct contact with water or in order to avoid accidental use thereof by users, the power ON/OFF switch is disposed in the lower part of the outer casing or at the backside of the outer casing. In this case, although the location of the power ON/OFF switch is not easily identifiable, it is not reliable enough and therefore it can be operated mischievously. Besides, a hand drying apparatus also includes an air volume regulator by which the administrator can adjust the air blower output in environments where silence is required. However, if a user takes liberties to increase the air volume, then the undesired noise can become a problem.

The present invention has been made to solve the above problems in the conventional technology and it is an object of the present invention to provide a hand drying apparatus that can prevent theft or mischievous operations, and that includes a lock mechanism for locking a drain tank or an operating unit such that removal of the drain tank or operations using the operating unit can be performed only by correctly unlocking the lock mechanism.

Means for Solving Problem

A hand drying apparatus according to an aspect of the present invention includes: a main box body that includes a hand insertion portion for allowing insertion/pulling out of hands and a water pan for collecting water drops blown away from hands; a high-pressure airstream generating device housed in the main box body for generating a high-pressure airstream; a nozzle through which a high-pressure airstream generated by the high-pressure airstream generating device is ejected inside the hand insertion portion; and a drain tank for accumulating water that is collected in the water pan, wherein the drain tank is attached to the main box body in a detachable manner, and a first lock mechanism is disposed for restricting removal of the drain tank.

Furthermore, another hand drying apparatus according to another aspect of the present invention further includes an air filter disposed at an air inlet of the main box body, wherein the air filter is housed in a filter housing having an openable-closable housing cap, and a second lock mechanism is disposed for restricting opening and closing of the housing cap.

Furthermore, another hand drying apparatus according to another aspect of the present invention further includes an operating unit for switching an apparatus operating state, wherein the operating unit is covered with an openable-closable operating unit cap, and a third lock mechanism is disposed for restricting opening and closing of the operating unit cap.

Effect of the Invention

According to an aspect of the present invention, a drain tank or an air filter can be removed only when an administrator or a cleaning worker intends to do so. As a result, it becomes possible to deter theft or mischievous operations. Besides, a situation in which the hand drying apparatus is switched OFF when a user wishes to use it or a situation in which the hand drying apparatus does not operate in a state set by the administrator can be prevented from occurring, thereby making the hand drying apparatus more friendly.

EXPLANATIONS OF LETTERS OR NUMERALS

Figure 1:
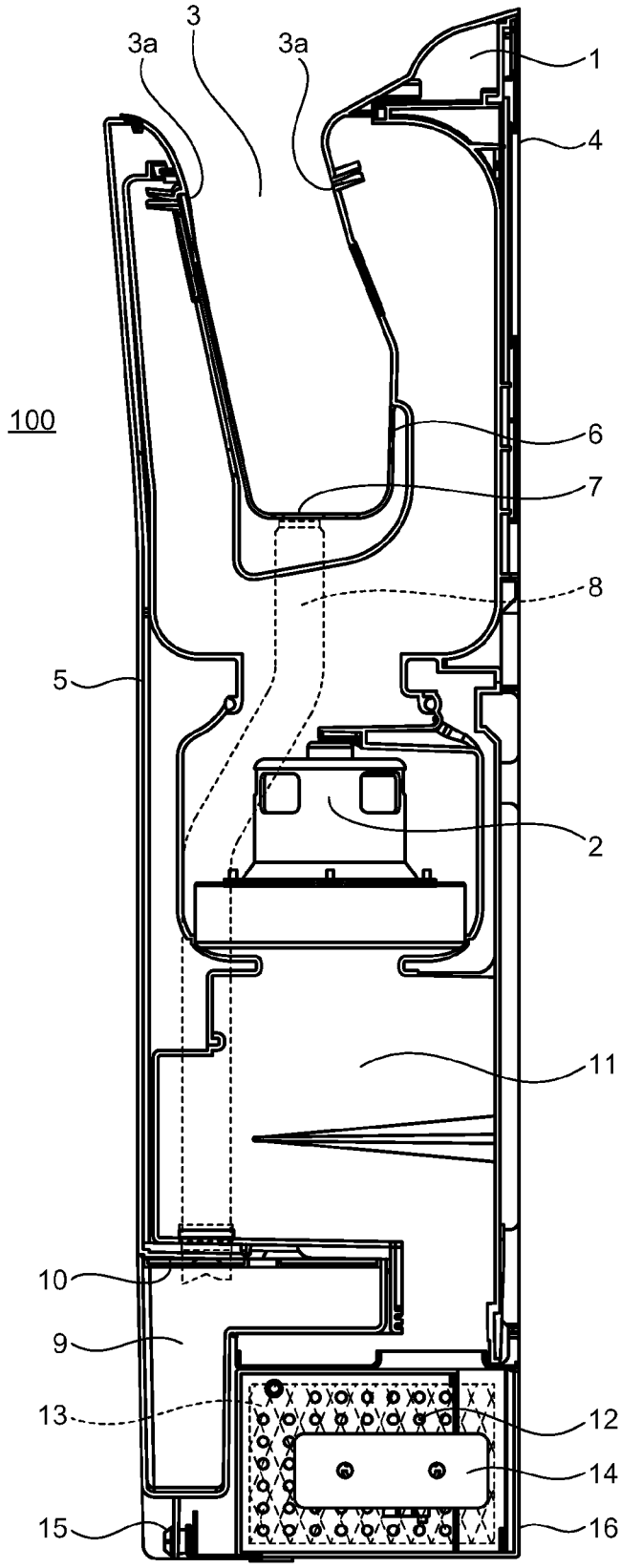
FIG. 1 is a vertical cross-sectional view of a hand drying apparatus according to a first embodiment of the present invention.

1 Main box body
2 Air blower (high-pressure airstream generating device)
3 Hand insertion portion
4 Base
5 Front side panel
6 Water pan
7 Drain outlet
8 Drainpipe
9 Drain tank
10 Cap of drain tank
11 Inlet passageway
12 Air inlet
13 Air filter
14 Heater
15, 15B Drain tank lock mechanism (first lock mechanism)
16 Heater box
17 Drain tank protrusion (engaging unit)
18 Operating unit cap
19, 19B Operating unit lock mechanism (third lock mechanism)
20 Dedicated key
21 Housing cap
22, 22B Air-filter-housing lock mechanism (second lock mechanism)
23 Backside panel
24 Air volume regulator
25 Power ON/OFF switch
26 Heater switch
27 Secret number verification screen
28 Secret number input button
29 Remote control
30 Remote-control light receiving unit (light receiving unit)

BEST MODE(S) FOR CARRYING OUT THE INVENTION

Firstly, an outline of a hand drying apparatus according to the present invention is explained followed by the description of specific embodiments.

In the hand drying apparatus according to the present invention, a high-pressure airstream generating device for generating a high-pressure airstream is installed in a main box body, in which a hand insertion portion is provided as a hollow space. An air inlet, through which the air is drawn in the high-pressure airstream generating device, opens at the lowermost part of the main box body as the end of an inlet passageway formed inside the main box body. To the air inlet is fixed an air filter for blocking entry of dust. Upon passing through the air filter, the air is heated by a heater disposed in the inlet passageway. On the lower side of the hand insertion portion in the main box body, a drain tank is fixed in a detachable manner and can be detached/attached by removal/insertion along the front-back direction. The high-pressure airstream generated by the high-pressure airstream generating device is guided to an air nozzle disposed at the top of the hand insertion portion. Through the air nozzle, the high-pressure airstream is ejected inside the hand insertion portion so that the water attached to the hands inserted in the hand insertion portion is blown away. The blown water is drained into the drain tank through a drain outlet provided to a water pan at the bottom of the hand insertion portion.

In the hand drying apparatus according to the present invention, a lock mechanism is provided to the drain tank. Thus, the drain tank can be removed when an administrator or a cleaning worker unlocks the lock mechanism using a dedicated key. Hence, other than certain people possessing the key, nobody can remove the drain tank. That makes it possible to deter mischievous operations or theft by users.

Moreover, in the hand drying apparatus according to the present invention, an engaging unit is disposed in the drain tank for restricting the removal of the air filter. Due to such a configuration, the air filter can be removed only after the lock mechanism for the drain tank is unlocked and the drain tank is removed. Thus, the lock mechanism for the drain tank also functions as a lock mechanism for the air filter.

In the hand drying apparatus, an operating unit covered with an openable-closable cap is disposed on a portion of the main box body that forms the outer casing. The operating unit includes a power ON/OFF switch, a heater switch, and an air volume regulator that is used to regulate the volume of the high-pressure airstream. In the hand drying apparatus according to the present invention, a lock mechanism is provided for the openable-closable cap of the operating unit. Due to such a configuration, opening and closing of the cap of the operating unit is not possible except for the administrator or the cleaning worker. That eliminates the concern about mischievous operations by users of the power ON/OFF switch or the regulator for the high-pressure airstream disposed in the operating unit.

Moreover, in the hand drying apparatus according to the present invention, a plurality of lock mechanisms can be unlocked using a single key. Besides, the plurality of lock mechanisms can be unlocked using the same unlocking method. Such a configuration enables achieving reduction in the time and effort of the cleaning worker while performing maintenance as well as enables achieving a simplified configuration that makes the hand drying apparatus economical. Meanwhile, for example, the unlocking method can include inputting a secret number from a single input unit or inputting signals to a single light receiving unit from a single remote control.

Furthermore, in the hand drying apparatus according to the present invention, a buzzer rings an audible alert if an attempt is made to remove the drain tank or the air filter or to open/close the operating unit cap without correctly unlocking the lock mechanism. Due to such a configuration, it becomes possible to deter theft or mischievous operations by users or unspecified persons. Besides, in case a mischievous operation or theft is attempted, the people around can be informed about the incident. That results in the enhancement of the product safety.

Exemplary embodiments for the hand drying apparatus according to the present invention will be described below in detail with reference to the accompanying drawings. The present invention is not limited to those embodiments.

First Embodiment

Figure 2:
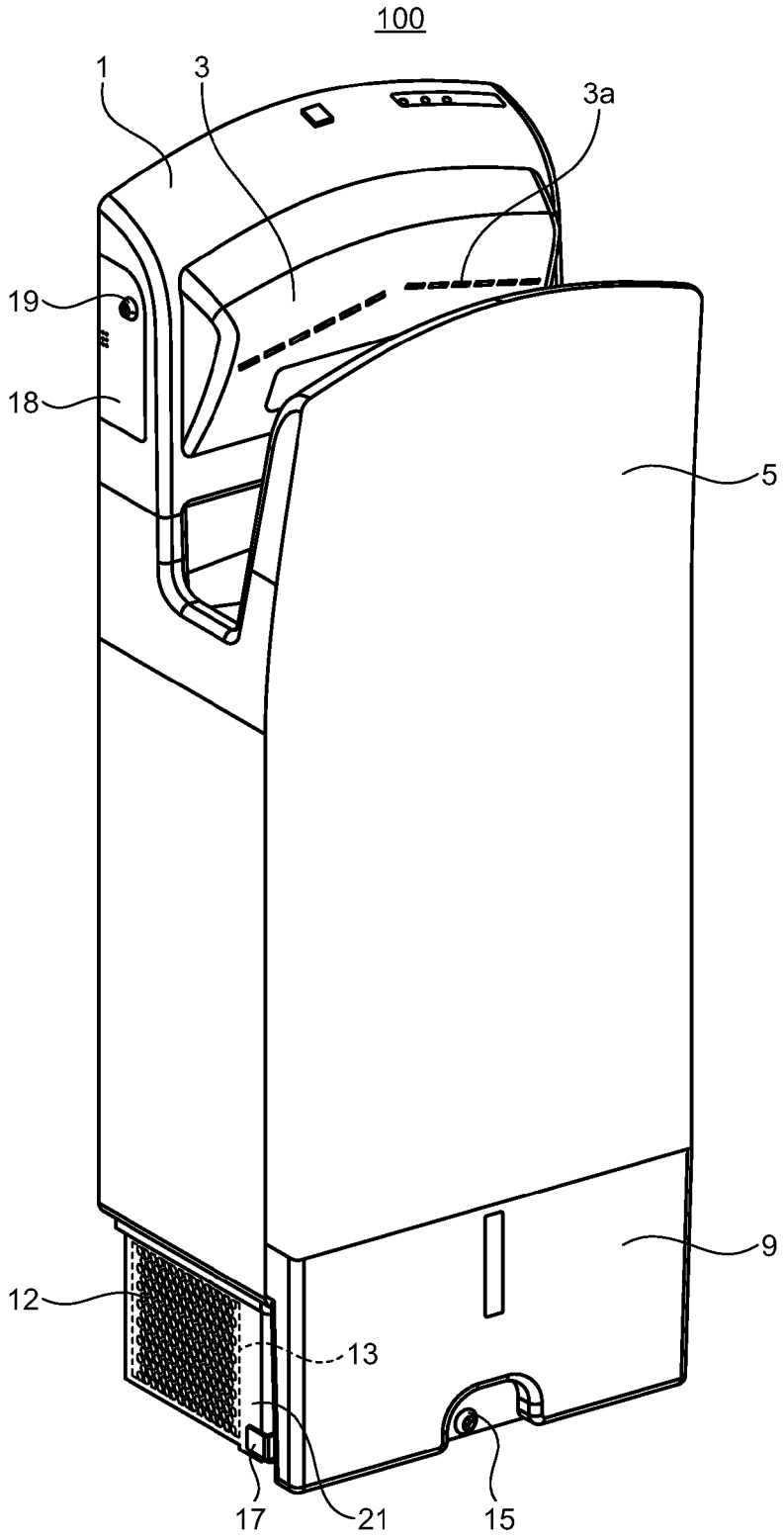
FIG. 2 is a perspective view of the hand drying apparatus according to the first embodiment.

FIG. 1 is a vertical cross-sectional view of the hand drying apparatus according to a first embodiment of the present invention. FIG. 2 is a perspective view of the hand drying apparatus according to the present embodiment. A hand drying apparatus 100 according to the present embodiment includes a main box body 1 forming an outer casing of the apparatus. The main box body 1 includes a base 4 forming a backside outer casing and a front side panel 5 forming a front side outer casing. At the top of the main box body 1 is provided a hand insertion portion 3 as a hollow space for allowing insertion/pulling out of hands. At the bottom of the hand insertion portion 3 is formed a water pan 6 for collecting the water blown away from the hands.

Inside the main box body 1 is installed an air blower (high-pressure airstream generating device) 2 for generating a high-pressure airstream. An air inlet 12, through which air is drawn in for the air blower 2, opens at the lowermost part of the main box body 1 as the end of an inlet passageway 11, which is formed inside the main box body 1. To the air inlet 12 is fixed an air filter 13 for blocking entry of dust. Upon passing through the air filter 13, the air is heated by a heater 14 disposed in the inlet passageway 11. At the lower side of the hand insertion portion 3 in the main box body 1 is detachably fixed a drain tank 9. The drain tank 9 can be detached/attached by removal/insertion along the front-back direction in a drawer-like manner. The high-pressure airstream generated by the air blower 2 is guided to an air nozzle 3*a* disposed at the top of the hand insertion portion 3. Through the air nozzle 3*a*, the high-pressure airstream is ejected inside the hand insertion portion 3 so that the water attached to the hands inserted in the hand insertion portion 3 is blown away. The blown water is then drained into the drain tank 9 through a drain outlet 7, which is provided to the water pan 6 at the bottom of the hand insertion portion 3, and via a drainpipe 8.

At the top of the front side of the main box body 1, the hand insertion portion 3 is formed as a hollow space open on both sides for allowing insertion/pulling out of hands. The water blown away inside the hand insertion portion 3 is collected in the water pan 6 having a slope and then guided to the drain outlet 7 at the lower end of the slope.

To the drain outlet 7 is connected the drainpipe 8. The water drained via the drainpipe 8 is accumulated in the drain tank 9 that is an open-type vessel. To the drain tank 9 is fixed a removable cap 10. The drain tank 9 and the cap 10 thereof are made of a chemical-resistant resin such as PP, ABS, or ASA, and can be cleaned by washing with a neutral detergent and alcohol. In order to reduce adhesion of dirt or curb growth of bacteria on the surface of the hand insertion portion 3, it is coated with a water-shedding coating of silicon series or fluorine series, or coated with a hydrophilic coating of titanium oxide, or impregnated with an antibacterial agent.

The air blower 2 includes a brushless DC motor (also possible to use a commutator motor or an induction motor), a driving circuit for driving the brushless DC motor, and a turbofan that is rotated by the brushless DC motor. In the present embodiment, the air blower 2 is fixed immediately beneath the hand insertion portion 3. In the inlet passageway 11 behind the air inlet 12 is disposed a heater box 16, inside which is installed the heater 14 that is a thermal storage type heater.

With reference to FIG. 2, at the top of the left side surface of the main box body 1 is disposed an operating unit (not illustrated) for switching the operating state of the apparatus. The operating unit is covered with an openable-closable operating unit cap 18. Moreover, the operating unit includes a power ON/OFF switch, a heater switch, and an air volume regulator.

Figure 3:
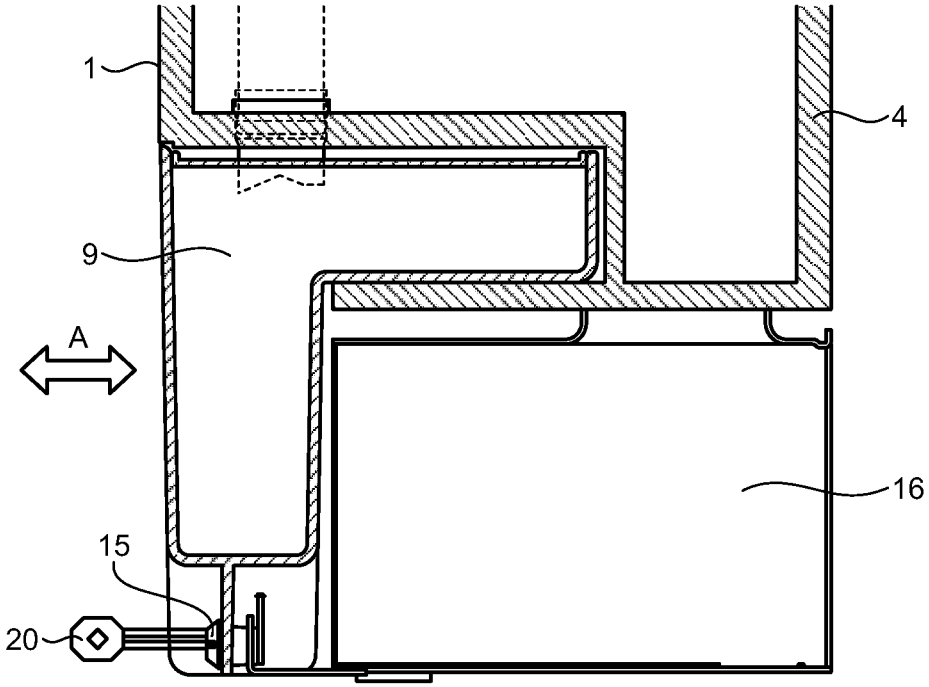
FIG. 3 is a right side cross-sectional view of the surrounding part of a drain tank 9 disposed on the lower side of a main box body 1.

FIG. 3 is a right side cross-sectional view of the surrounding part of the drain tank 9 disposed on the lower side of the main box body 1. As indicated by an arrow A in FIG. 3, the drain tank 9 can be removed/inserted along the front-back direction. In the lower part at the center of the drain tank 9 is disposed a drain tank lock mechanism (first lock mechanism) 15 for restricting the removal of the drain tank 9. Inside a key inserting portion of the drain tank lock mechanism 15 provided on the drain tank 9, a predetermined groove and a projection is provided. The drain tank lock mechanism 15 is rotated (unlocked) by inserting therein a dedicated key 20 manufactured to match the shape of the key inserting portion. On the other hand, inside the heater box 16, a portion that engages with the drain tank lock mechanism 15 is present such that the engagement therebetween at the time when they overlap makes it impossible to pull out the drain tank 9. Due to such a configuration, only the administrator or the cleaning worker possessing the dedicated key can detach and attach the drain tank 9. That makes it possible to deter mischievous operations or theft.

Figure 4:
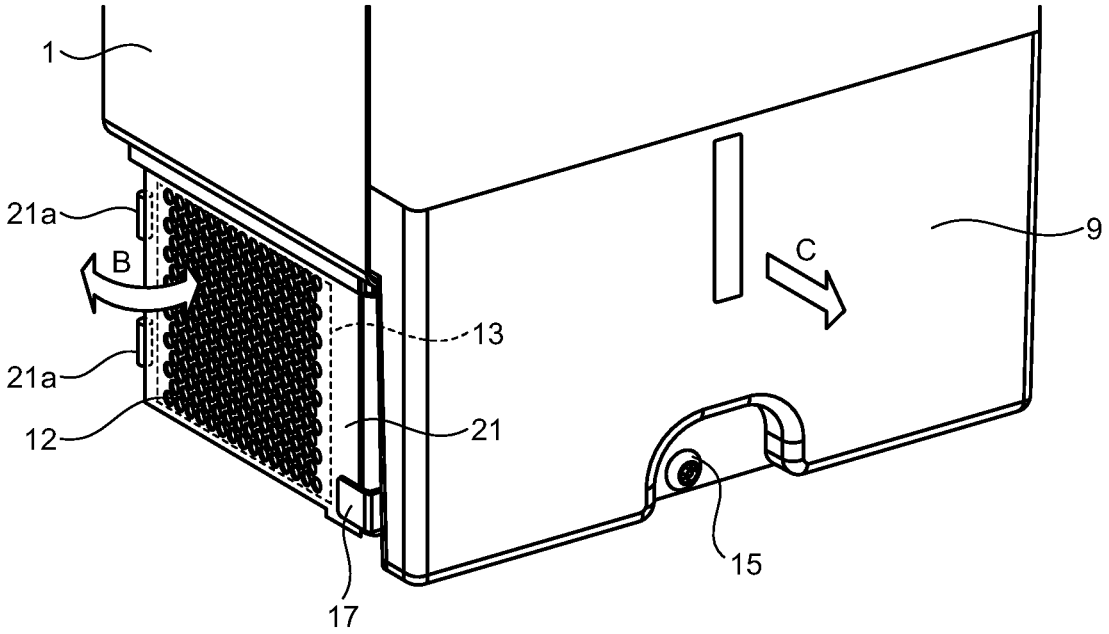
FIG. 4 is an enlarged view of the drain tank and an air filter housing illustrated in FIG. 2.

FIG. 4 is an enlarged view of the drain tank and an air filter housing illustrated in FIG. 2. The air filter housing is disposed at the opening of the air inlet 12 and includes an openable-closable housing cap 21. With hinges 21*a* fixed at one end, the housing cap 21 is linked to the heater box 16. The housing cap 21 rotates around the hinges 21*a*, which function as the supporting points, and opens to the near side as indicated by an arrow B so that the air filter 13 disposed inside can be removed. On the open side edge of the housing cap 21, rests a drain tank protrusion 17 extending from the drain tank 9. The drain tank protrusion 17 is manufactured by folding a strip of metal plate in a cross-sectional L-shape and is fixed to the drain tank 9 by a screw (not illustrated). The drain tank protrusion 17 restricts the opening of the housing cap 21. When the drain tank 9 is pulled out along an arrow C, the drain tank protrusion 17 comes off from the housing cap 21. That makes it possible to open the housing cap 21 and in turn to remove the air filter 13. Herein, unless the dedicated key 20 is used to unlock the drain tank lock mechanism 15, the drain tank 9 cannot be pulled out. That means that the air filter 13 also cannot be removed. Thus, the drain tank lock mechanism 15 also serves as a lock mechanism for restricting the removal of the air filter 13. Such a configuration eliminates the need to dispose a separate lock mechanism for deterring theft or mischievous operations of the air filter 13. Hence, the configuration can be simplified at a low cost. Incidentally, it is also possible to manufacture the drain tank protrusion 17 in an integrated manner with the drain tank 9.

Figure 5:
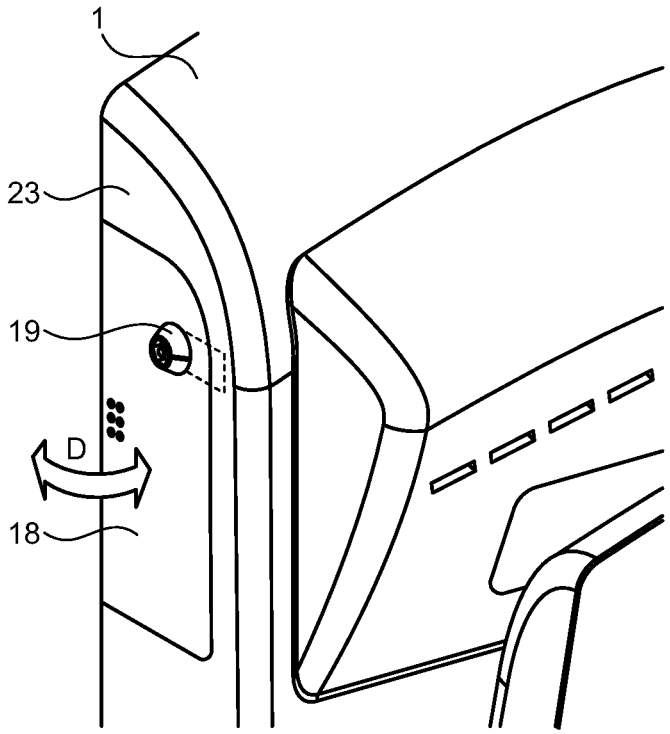
FIG. 5 is an enlarged view illustrating the surrounding part of an operating unit cap illustrated in FIG. 2.
Figure 6:
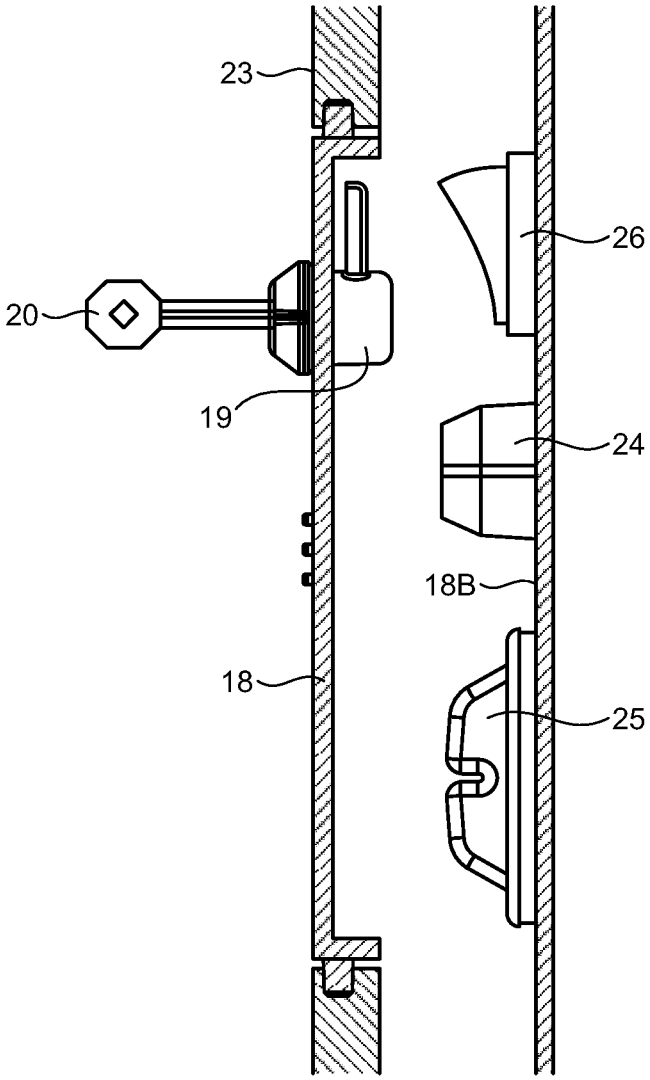
FIG. 6 is a cross-sectional view of an operating unit.

FIG. 5 is an enlarged view illustrating the surrounding part of the operating unit cap illustrated in FIG. 2. FIG. 6 is a cross-sectional view of the operating unit. With a hinge mechanism (not illustrated) fixed at one end, the operating unit cap 18 is linked to the main box body. The operating unit cap 18 rotates around the hinge mechanism, which functions as the supporting point, and opens to the near side as indicated by an arrow D in FIG. 5. In that condition, a power ON/OFF switch 25, a heater switch 26, and an air volume regulator 24 disposed on an operating unit 18B inside can be operated. On the operating unit cap 18, an operating unit lock mechanism (third lock mechanism) 19 is disposed for restricting the opening and closing of the operating unit cap 18. Inside the operating unit lock mechanism 19, a key inserting portion is formed with a predetermined groove and a projection. In order to rotate (unlock) the operating unit lock mechanism 19, the dedicated key 20 manufactured to match the shape of the key inserting portion needs to be inserted therein. When the operating unit lock mechanism 19 is rotated, the leading end thereof overlaps with a portion of a backside panel 23 thereby restricting the opening of the operating unit cap 18. Due to such a configuration; the power ON/OFF switch 25, the heater switch 26, and the air volume regulator 24 disposed on the operating unit 18B are prevented from being mischievously operated by the users. That is, only the person in charge possessing the dedicated key 20 can operate the power ON/OFF switch 25, the heater switch 26, and the air volume regulator 24. That makes the supervision task easier.

In addition, the key inserting portion of the drain tank lock mechanism (first lock mechanism) 15 and the key inserting portion of the operating unit lock mechanism (third lock mechanism) 19 can be made to have the same shape such that a single dedicated key can be used to unlock those lock mechanisms. Such a configuration makes the supervision task easier as well as enhances the workability.

Second Embodiment

Figure 7:
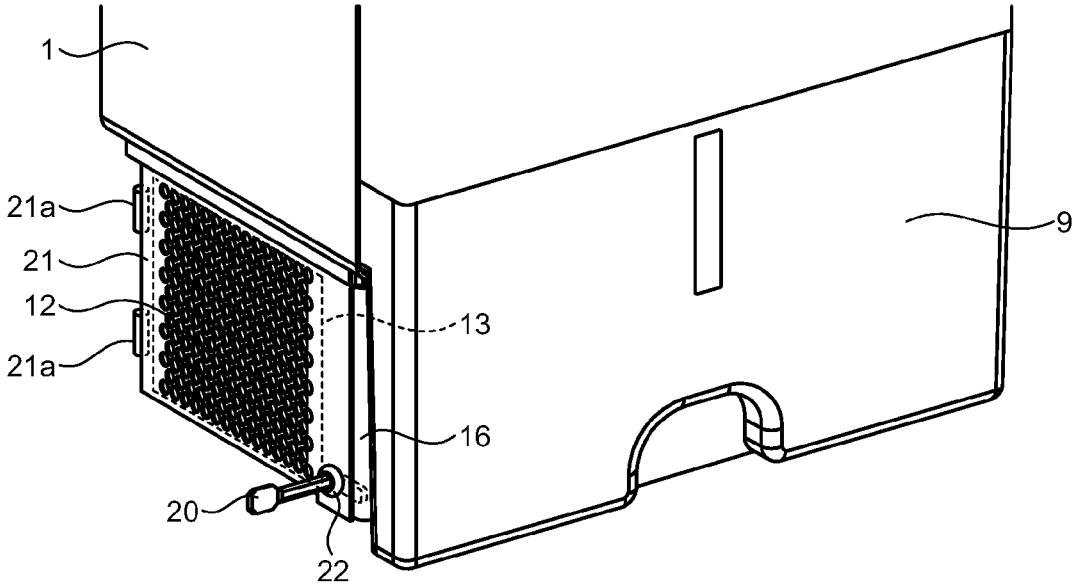
FIG. 7 is an enlarged view of the air filter housing disposed in the hand drying apparatus according to a second embodiment of the present invention.

FIG. 7 is an enlarged view of the air filter housing disposed in the hand drying apparatus according to a second embodiment of the present invention. Herein, the elements identical to those in the first embodiment are referred to by the same reference numerals and the explanation thereof is not repeated.

The air filter housing is disposed at the opening of the air inlet 12 and includes the openable-closable housing cap 21. With the hinges 21*a* fixed at one end, the housing cap 21 is linked to the heater box 16. The housing cap 21 rotates around the hinges 21*a*, which function as the supporting points, and opens to the near side so that the air filter 13 disposed inside can be removed. At the open side edge of the housing cap 21 is disposed an air-filter-housing lock mechanism (second lock mechanism) 22. Inside the air-filter-housing lock mechanism 22, a key inserting portion is formed with a predetermined groove and a projection. The air-filter-housing lock mechanism 22 can be rotated (unlocked) by inserting therein the dedicated key 20 manufactured to match the shape of the key inserting portion. Furthermore, the air-filter-housing lock mechanism 22 and the heater box 16 are configured to partially engage with each other. When the air-filter-housing lock mechanism 22 and the heater box 16 are overlapped, the housing cap 21 cannot be opened and the air filter 13 cannot be removed. When the dedicated key 20 is used to rotate the air-filter-housing lock mechanism 22, the air filter 13 disposed inside can be removed. Due to such a configuration, only the administrator or the cleaning worker possessing the dedicated key can remove the air filter 13. That makes it possible to deter theft or mischievous operations. Apart from that, the configuration is identical to that in the first embodiment.

In addition, the key inserting portions of the air-filter-housing lock mechanism (second lock mechanism) 22, the drain tank lock mechanism (first lock mechanism) 15, and the operating unit lock mechanism (third lock mechanism) 19 can be made to have the same shape such that a single dedicated key can be used to unlock those lock mechanisms. Such a configuration makes the supervision task easier as well as enhances the workability. Such an effect can be achieved by using a single dedicated key to perform locking of at least two lock mechanisms.

Third Embodiment

Figure 8:
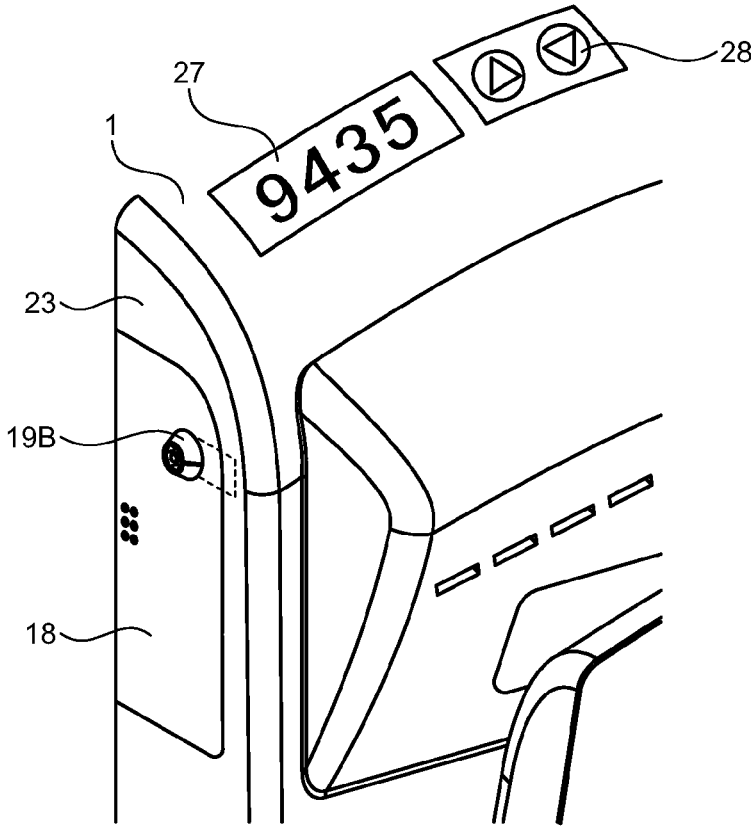
FIG. 8 is an enlarged view illustrating the surrounding part of the operating unit cap in the hand drying apparatus according to a third embodiment of the present invention.

FIG. 8 is an enlarged view illustrating the surrounding part of the operating unit cap in the hand drying apparatus according to a third embodiment of the present invention. Herein, the elements identical to those in the first embodiment are referred to by the same reference numerals and the explanation thereof is not repeated.

The operating unit cap 18 is linked to the main box body 1 with a hinge mechanism (not illustrated) fixed at one end of the operating unit cap 18. The operating unit cap 18 rotates around the hinge mechanism, which functions as the supporting point, and opens to the near side. In that configuration, the power ON/OFF switch 25, the heater switch 26, and the air volume regulator 24 disposed inside the operating unit 18B can be operated. On the operating unit cap 18 is disposed an operating unit lock mechanism (third lock mechanism) 19B for restricting the opening and closing of the operating unit cap 18. Moreover, at the top of the main box body 1 is disposed a secret number verification screen (secret number input unit) 27 for unlocking the operating unit lock mechanism 19B. Adjacent to the secret number verification screen 27 is provided a secret number input button 28 that can be used by the administrator to set an arbitrary secret number. At the time of cleaning, when the secret number set as the initial setting is input in the secret number verification screen 27, a microcomputer installed inside the product recognizes the input secret number and outputs an unlock signal if the secret number matches. Because of that, the operating unit lock mechanism 19B is unlocked. Due to such a configuration; the power ON/OFF switch 25, the heater switch 26, and the air volume regulator 24 disposed inside the operating unit 18B are prevented from being mischievously operated by the users. That is, only the administrator or the cleaning worker who has set the secret number can operate those components. That makes the supervision task easier. Apart from that, the other configuration is identical to that in the first embodiment.

In addition, in the identical manner of the operating unit lock mechanism (third lock mechanism) 19B according to the present embodiment, unlocking of the drain tank lock mechanism (first lock mechanism) 15 according to the first embodiment and unlocking of the air-filter-housing lock mechanism (second lock mechanism) 22 according to the second embodiment can also be performed by inputting a secret number in the same secret number verification screen 27 disposed in the main box body 1. In that case, for example, distinction can be done by setting a secret number starting with "1" for unlocking the operating unit lock mechanism 19 and setting a secret number starting with "2" for unlocking the drain tank lock mechanism 15. Due to such a configuration, a plurality of lock mechanisms can be unlocked without having to use dedicated keys. That makes the supervision task easier and enables achieving simplification of the apparatus.

Fourth Embodiment

Figure 9:
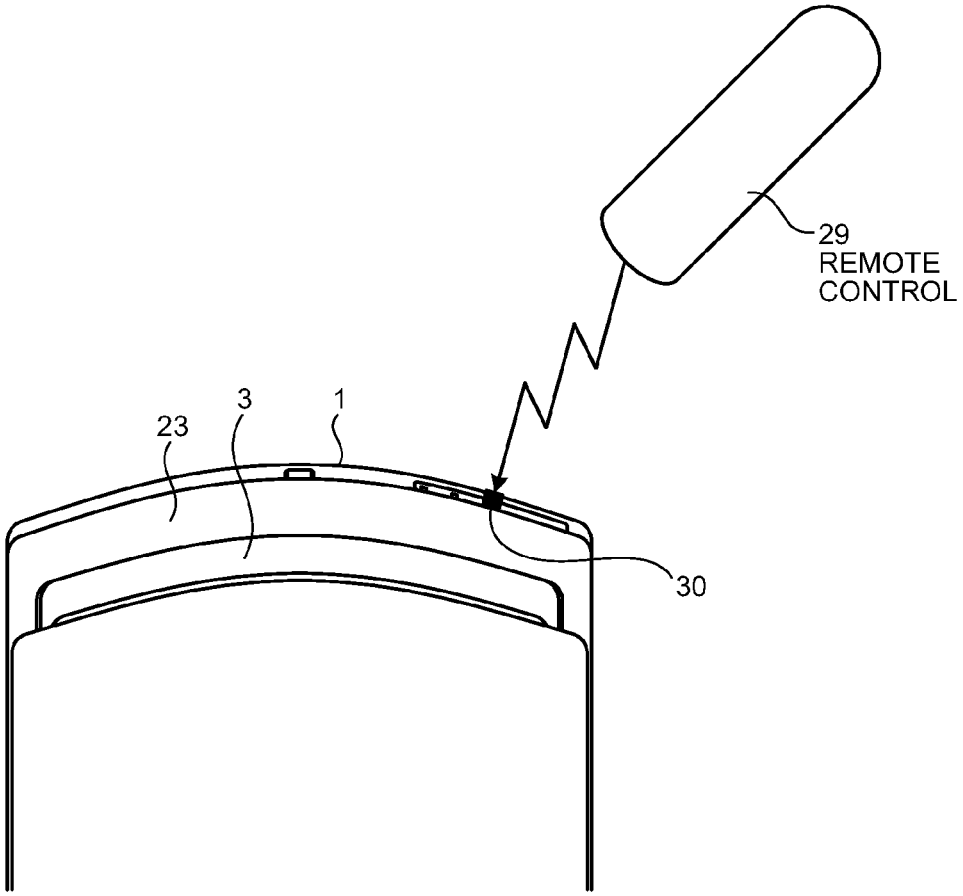
FIG. 9 is a schematic diagram explaining a condition when a light receiving unit in the hand drying apparatus according to a fourth embodiment of the present invention and a remote control perform communication.

FIG. 9 is a schematic diagram explaining a condition when a light receiving unit in the hand drying apparatus according to a fourth embodiment of the present invention and a remote control perform communication. Herein, the elements identical to those in the first embodiment are referred to by the same reference numerals and the explanation thereof is not repeated.

As described above, there is a danger that the drain tank or the air filter is stolen or a danger that the power ON/OFF switch 25 or the air volume regulator 24 is mischievously operated. Hence, lock mechanisms are individually disposed to deter theft or mischievous operations. In the present embodiment, a remote-control light receiving unit 30 is disposed at the top of the main box body 1 for receiving transmission details in the form of light from a remote control. Herein, a dedicated remote control 29 transmits signals for locking or unlocking the lock mechanisms. The remote-control light receiving unit 30 receives those signals. A microcomputer installed inside the main box body then recognizes the transmission details and locks or unlocks the lock mechanisms in an automatic manner.

The operations of locking and unlocking using the signals input to the remote-control light receiving unit 30 from the remote control 29 are applied as: the operations of locking and unlocking the drain tank lock mechanism (first lock mechanism) 15 and the operating unit lock mechanism (third lock mechanism) 19 according to the first embodiment; the operations of locking and unlocking the air-filter-housing lock mechanism (second lock mechanism) 22 according to the second embodiment. Such a configuration enables the administrator or the cleaning worker to easily deter theft or mischievous operations. Moreover, by using the same remote control 29 to perform the operations of locking and unlocking with respect to the abovementioned plurality of lock mechanisms, it becomes possible to simplify the apparatus. Such an effect can be achieved by performing the operations of locking and unlocking with respect to at least two lock mechanisms using the signals input to the same remote-control light receiving unit 30 from the same remote control 29. In this case, if the locking-unlocking configuration using the dedicated key 20 is concurrently provided, it becomes possible to further improve the usability.

Fifth Embodiment

Figure 10:
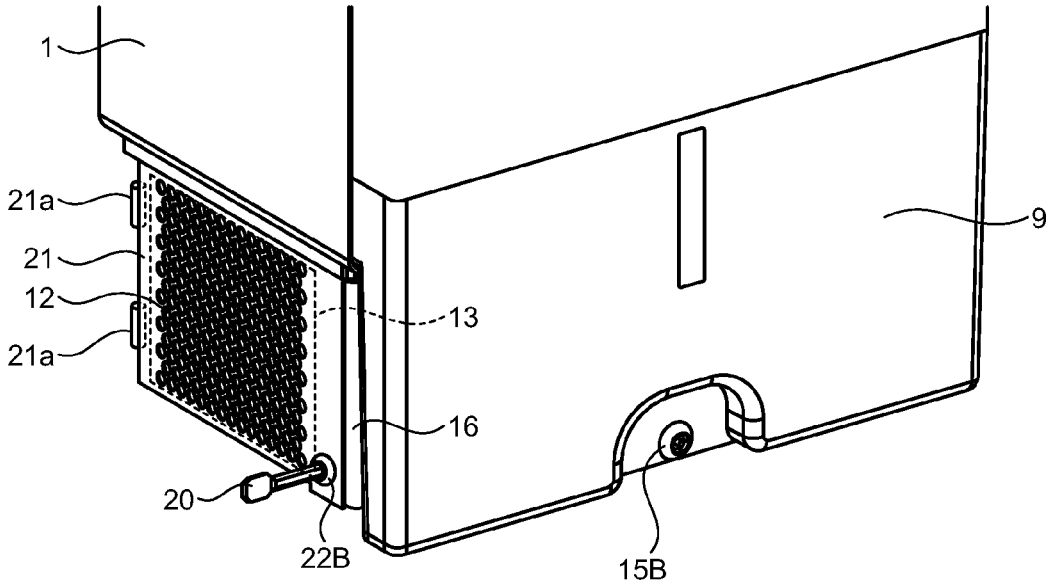
FIG. 10 is an enlarged view of the air filter housing disposed in the hand drying apparatus according to a fifth embodiment of the present invention.

FIG. 10 is an enlarged view of the air filter housing disposed in the hand drying apparatus according to a fifth embodiment of the present invention. Herein, the elements identical to those in the first embodiment are referred to by the same reference numerals and the explanation thereof is not repeated. In the present embodiment, a security alarm is disposed for ringing an audible alert in case an attempt is made to remove the drain tank 9 or to open the housing cap 21 without correctly unlocking the lock mechanisms.

As described above, the removable drain tank 9 or the air filter 13 can be stolen. Hence, a buzzer (security alarm) that rings an audible alert is disposed inside the main box body 1. If an attempt is made to remove the drain tank 9 or to open the housing cap 21 without correctly unlocking the lock mechanisms, the buzzer rings the audible alert as a warning against a mischievous operation. Moreover, at the time of cleaning, by inserting the dedicated key 20 in a security alarm cancel button (commonly used by a drain tank lock mechanism (first lock mechanism) 15B and an air-filter-housing lock mechanism (second lock mechanism) 22B alike), that is, by unlocking the lock mechanisms in a correct manner; an unlock signal is input and the signal is recognized by a microcomputer installed inside the main box body 1. The microcomputer then disables the security alarm function thereby enabling removal without an audible alert. Due to such a configuration, users doing mischievous operations such as theft can be warned and the people around can be informed about any such incident. That makes the supervision task easier.

In the present embodiment, in an identical manner to removing the drain tank or opening the housing cap, the audible alert can also be rung if an attempt is made to open the operating unit cap without correctly unlocking the lock mechanism.

INDUSTRIAL APPLICABILITY

The present invention can be suitably applied to a hand drying apparatus for hygienic drying of wet hands after hand-washing, and can be particularly suitably applied to a hand drying apparatus that includes a drain tank or an air filter attached to a main body in a detachable manner or includes an openable-closable operating unit.

The invention claimed is:

1. A hand drying apparatus comprising:

a main box body that includes a hand insertion portion for allowing insertion/pulling out of hands and a water pan for collecting water drops blown away from hands;

a high-pressure airstream generating device housed in the main box body for generating a high-pressure airstream;

a nozzle through which a high-pressure airstream generated by the high-pressure airstream generating device is ejected inside the hand insertion portion;

a drain tank for accumulating water that is collected in the water pan, wherein the drain tank is attached to the main box body in a detachable manner;

a first lock mechanism is disposed for restricting removal of the drain tank;

an air filter disposed at an air inlet of the main box body, wherein the air filter is housed in a filter housing having an openable-closable housing cap; and a protrusion is formed on the drain tank for restricting opening and closing of the housing cap, the protrusion at least partially covering the housing cap in a position that the drain tank is attached to the main box body and, only when the drain tank is removed, allowing the housing cap to open and close, and the first lock mechanism also restricts opening and closing of the housing cap.

2. The hand drying apparatus according to claim 1, wherein a security alarm is disposed for ringing an audible alert if the drain tank is removed without correctly unlocking the first lock mechanism.

3. The hand drying apparatus according to claim 1, further comprising an air filter disposed at an air inlet of the main box body, wherein the air filter is housed in a filter housing having an openable-closable housing cap, and a second lock mechanism is disposed for restricting opening and closing of the housing cap.

4. The hand drying apparatus according to claim 3, wherein the first lock mechanism and the second lock mechanism are unlocked by a single key.

5. The hand drying apparatus according to claim 1, further comprising an operating unit for switching an apparatus operating state, wherein the operating unit is covered with an openable-closable operating unit cap, and a third lock mechanism is disposed for restricting opening and closing of the operating unit cap.

6. The hand drying apparatus according to claim 5, wherein the first lock mechanism and the third lock mechanism are unlocked by a single key.

7. The hand drying apparatus according to claim 3, further comprising an operating unit for switching an apparatus operating state, wherein the operating unit is covered with an openable-closable operating unit cap, and a third lock mechanism is disposed for restricting opening and closing of the operating unit cap.

8. The hand drying apparatus according to claim 7, wherein at least two lock mechanisms from among the first lock mechanism to the third lock mechanism are unlocked by a single key.

9. A hand drying apparatus comprising:

a main box body that includes a hand insertion portion for allowing insertion/pulling out of hands and a water pan for collecting water drops blown away from hands;

a high-pressure airstream generating device housed in the main box body for generating a high-pressure airstream;

a nozzle through which a high-pressure airstream generated by the high-pressure airstream generating device is ejected inside the hand insertion portion;

a heater box provided in the main box body, the heater box including a heater disposed therein; and an air filter disposed at an air inlet of the main box body, wherein the air filter is housed in a filter housing in the main box body, the filter housing having an openable-closable housing cap, the housing cap being linked to the heater box by hinges, and a lock mechanism is disposed for restricting opening and closing of the housing cap, the lock mechanism engaged with the heater box in a locked condition.

10. The hand drying apparatus according to claim 9, wherein a security alarm is disposed for ringing an audible alert if the housing cap is opened without correctly unlocking the second lock mechanism.

11. The hand drying apparatus according to claim 9, further comprising an operating unit for switching an apparatus operating state, wherein the operating unit is covered with an openable-closable operating unit cap, and a second lock mechanism is disposed for restricting opening and closing of the operating unit cap.

12. The hand drying apparatus according to claim 11, wherein the lock mechanism and the second lock mechanism are unlocked by a single key.

13. A hand drying apparatus comprising:

a main box body that includes a hand insertion portion for allowing insertion/pulling out of hands and a water pan for collecting water drops blown away from hands;

a high-pressure airstream generating device housed in the main box body for generating a high-pressure airstream;

a nozzle through which a high-pressure airstream generated by the high-pressure airstream generating device is ejected inside the hand insertion portion; and an operating unit for switching an apparatus operating state including a power on/off switch, a heater switch and an air volume regulator, wherein the operating unit is covered with an openable-closable operating unit cap, and a lock mechanism is disposed for restricting opening and closing of the operating unit cap.

14. The hand drying apparatus according to claim 13, wherein a security alarm is disposed for ringing an audible alert if the operating unit cap is opened without correctly unlocking the lock mechanism.

15. The hand drying apparatus according to claim 1, wherein the protrusion has an L-shape cross-section.

* * * * *